US010155300B2

(12) United States Patent
Graham et al.

(10) Patent No.: US 10,155,300 B2
(45) Date of Patent: Dec. 18, 2018

(54) PRINTED ABRASIVE ARTICLE

(71) Applicant: 3M INNOVATIVE PROPERTIES COMPANY, St. Paul, MN (US)

(72) Inventors: Paul D. Graham, Woodbury, MN (US); Douglas A. Davis, Cottage Grove, MN (US); Yugeun P. Yang, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 8 days.

(21) Appl. No.: 15/525,097

(22) PCT Filed: Oct. 23, 2015

(86) PCT No.: PCT/US2015/057120
§ 371 (c)(1),
(2) Date: May 8, 2017

(87) PCT Pub. No.: WO2016/073227
PCT Pub. Date: May 12, 2016

(65) Prior Publication Data

US 2017/0334041 A1 Nov. 23, 2017

Related U.S. Application Data

(60) Provisional application No. 62/076,874, filed on Nov. 7, 2014.

(51) Int. Cl.
*B24D 11/00* (2006.01)
*B24D 3/00* (2006.01)
*B24D 11/02* (2006.01)

(52) U.S. Cl.
CPC ..... *B24D 11/005* (2013.01); *B24D 3/004* (2013.01); *B24D 11/001* (2013.01); *B24D 11/02* (2013.01); *B24D 2205/00* (2013.01)

(58) Field of Classification Search
CPC .... B24D 11/005; B24D 11/001; B24D 3/004; B24D 2205/00
See application file for complete search history.

(56) References Cited

U.S. PATENT DOCUMENTS 2,871,218 A 1/1959 Schollenberger
3,645,835 A 2/1972 Hodgson
(Continued)

FOREIGN PATENT DOCUMENTS

CN 201 752 866 3/2011
CN 202 185 840 4/2012
(Continued)

OTHER PUBLICATIONS

Dahlquist Criterion, "Handbook of Pressure Sensitive Adhesive Technology," 2nd ed. (1989), pp. 172-176.
(Continued)

*Primary Examiner* — Pegah Parvini

(57) ABSTRACT

A flexible abrasive article is provided with a first, non-tacky base layer having opposed first and second major surfaces. An ink layer is disposed on the first major surface of the first base layer, while a second, thermoplastic base layer is disposed on the ink layer whereby the ink layer is located between the first and second base layers. Disposed on the second base layer is an abrasive layer such that the second base layer is located between the abrasive layer and the ink layer. Compared with conventional printed flexible adhesive articles, the provided articles improved robustness while avoiding manufacturing difficulties related to flexographic printing onto abrasive coated articles.

15 Claims, 2 Drawing Sheets

(56) References Cited

U.S. PATENT DOCUMENTS

| | | | | | |
|---|---|---|---|---|---|
| 4,595,001 | A | | 6/1986 | Potter | |
| RE33,353 | E | | 9/1990 | Heinecke | |
| 5,088,483 | A | | 2/1992 | Heinecke | |
| 5,152,917 | A | | 10/1992 | Pieper | |
| 5,201,101 | A | | 4/1993 | Rouser | |
| 5,254,194 | A | * | 10/1993 | Ott | A44B 18/0011 156/176 |
| 5,766,277 | A | * | 6/1998 | DeVoe | B24D 3/28 51/295 |
| 5,785,784 | A | * | 7/1998 | Chesley | A44B 18/0049 156/231 |
| 6,428,407 | B1 | * | 8/2002 | Elder | B24D 11/00 283/101 |
| 6,838,589 | B2 | | 1/2005 | Liedtke | |
| 6,846,232 | B2 | | 1/2005 | Braunschweig | |
| 6,884,504 | B2 | | 4/2005 | Liu | |
| 8,038,750 | B2 | * | 10/2011 | Pribyl | B24D 3/28 51/295 |
| 2003/0022604 | A1 | | 1/2003 | Annen | |
| 2011/0021114 | A1 | * | 1/2011 | McArdle | B24B 37/245 451/8 |
| 2012/0000135 | A1 | | 1/2012 | Eilers | |
| 2012/0231707 | A1 | * | 9/2012 | Pahl | B24D 3/346 451/59 |

FOREIGN PATENT DOCUMENTS

| | | | |
|---|---|---|---|
| JP | 62-39972 | U | 3/1987 |
| JP | 02-157357 | | 6/1990 |
| JP | 2000141232 | | 5/2000 |
| KR | 20010047920 | | 10/2002 |
| WO | WO 1992/02336 | | 2/1992 |
| WO | WO 1993/20976 | | 10/1993 |
| WO | WO 1995/11772 | | 5/1995 |
| WO | WO 2007/002338 | | 1/2007 |
| WO | WO 2009/011973 | | 1/2009 |
| WO | WO 2010/002697 | | 1/2010 |
| WO | WO 2015/167910 | | 11/2015 |
| WO | WO 2016/073227 | | 5/2016 |

OTHER PUBLICATIONS

Flexography: Principles and Practices, 4th ed., by the Foundation of Flexographic Technical Association, pp. 4-6 & 15-23 (1991).

* cited by examiner

PRINTED ABRASIVE ARTICLE

CROSS REFERENCE TO RELATED APPLICATIONS

This application is a national stage filing under 35 U.S.C. 371 of PCT/US2015/057120, filed 23 Oct. 2015, which claims the benefit of U.S. Provisional Patent Application No. 62/076,874 filed 7 Nov. 2014, the disclosures of which are incorporated by reference in their entirety herein.

FIELD OF THE INVENTION

Provided herein are flexible abrasive articles and methods of making the same. These flexible abrasive articles, more particularly, include one or more printed images.

BACKGROUND

Flexible abrasive articles are widely used in consumer and industrial sanding and finishing applications. Substrates commonly used in these applications include, for example, wood materials such as moldings, raised panels, carvings, and flutings, as well as painted and gel coated materials such as automotive and marine exteriors. The flexibility of these abrasive articles allows them to conform to substrates that have curved, recessed, or otherwise complex surfaces.

Printed flexible abrasives offer further benefits to both manufacturers and consumers. The ability to impart an image to an abrasive can enhance its appearance and provide branding or promotional information. The inclusion of printed information can also be effective in communicating technical details to the end user, such as its grit size. Printing ornamental and functional images directly on the abrasive is often preferred over placing such images on product packaging because these products can easily become separated from their packaging.

SUMMARY

In many situations, it is desirable for the printed image to be visible from the abrasive side of the backing. To achieve this, manufacturers have generally printed images directly onto either the front or back side of the backing. For the reasons described below, however, both have significant technical drawbacks.

The backing materials used in preferred flexible abrasives were found to be quite limiting with respect to the manufacturing of a printed abrasive article. To obtain a flexible abrasive with the desired properties, the backing is generally made from a relatively soft polymer that stretches easily along transverse directions, i.e., along the plane of the backing. In a large scale manufacturing process, coating an abrasive onto these backings usually requires that the backing be secured to a comparatively stiffer liner, or support film, to enable a predictable and uniform coating.

Printing the desired graphics directly on the side of the backing facing the abrasive layer (i.e., the top side) is problematic because the ink interferes with the adhesion of the abrasive coating. This problem leads to shear-induced failure at the interface between the relatively brittle ink layer and backing when the abrasive article is stretched along its plane. Conversely, printing graphics on the opposite side of the backing (i.e. the bottom side) is impractical because the back surface of the backing is blocked by the support film. While it is possible to coat the abrasive onto the composite film beforehand and strip off the support film prior to printing, this introduces another problem, namely that high volume printing equipment suffer damage as a result of friction between the coated abrasive and rollers that guide the web.

While this problem can be answered by masking off abrasive surfaces to protect the rollers, the additional processing steps associated with placing and later removing the masking material significantly complicates manufacturing. Doing so also incurs further costs associated with providing, and later disposing of, the masking material.

The provided abrasive articles overcome all of these problems by placing the image within the interior of the backing, thus overcoming drawbacks to printing onto its outer surfaces. As a result, images of very high integrity can be imparted to abrasive backings using manufacturing methods that are also highly efficient. As a further advantage, the resulting abrasive articles can display vibrant background colors for grade differentiation, attractive branding graphics, and/or easily legible technical information not previously attainable with conventional articles.

In one aspect, a flexible abrasive article is provided. The flexible abrasive article comprises: a first base layer having opposed first and second major surfaces, wherein the first base layer is non-tacky under ambient conditions; an ink layer disposed on the first major surface of the first base layer; a second base layer disposed on the ink layer whereby the ink layer is located between the first and second base layers and wherein the second base layer comprises a thermoplastic; and an abrasive layer disposed on the second base layer whereby the second base layer is located between the abrasive layer and the ink layer.

In another aspect, a method of making an abrasive article comprising: extrusion coating a first base layer onto a support layer, the first base layer presenting an exposed major surface that is non-tacky at ambient conditions; printing an ink layer onto the exposed major surface opposite the support layer; extrusion coating a second base layer onto the ink layer to confine the ink layer between the first and second base layers, wherein the second base layer comprises a thermoplastic; and applying an abrasive coating onto the second base layer.

In yet another aspect, a method of making an abrasive article is provided, comprising: extrusion coating a first base layer onto a first support layer, wherein the first base layer is non-tacky at ambient conditions; printing an ink layer onto an exposed major surface of the first base layer; extrusion coating a second base layer; applying an abrasive coating onto the second base layer; and thermally bonding the second base layer to the ink layer.

BRIEF DESCRIPTION OF THE DRAWINGS

Exemplary embodiments shall be further described with reference to the following drawings.

DEFINITIONS

Figure 1:
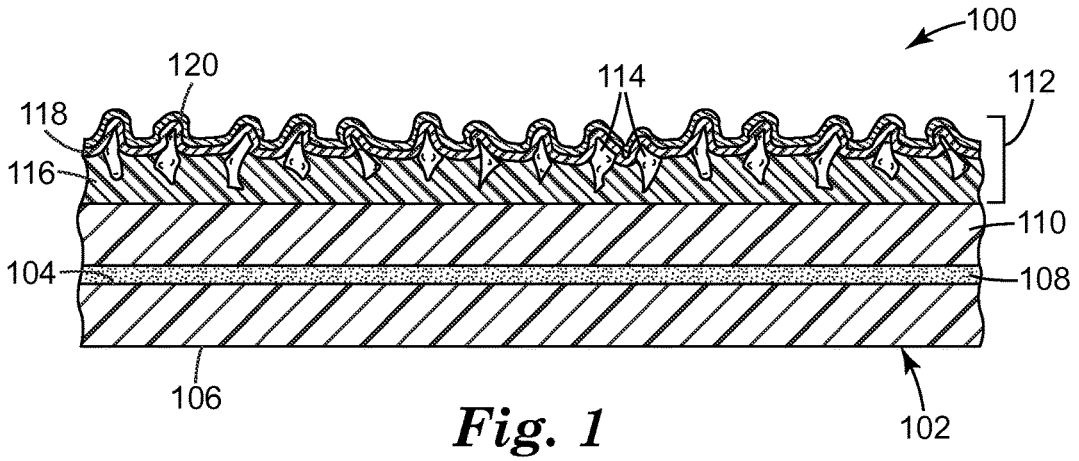
FIG. 1 is a side cross-sectional view of an abrasive article according to a first exemplary embodiment.

As used herein:

"ambient conditions" means at approximately 25 degrees Centigrade and 101 kilopascals (or 1 atmosphere) pressure;

"conformable" means capable of adjusting shape in response to an applied mechanical force;

"layer" refers to either a discontinuous or continuous coating of material extending across all or a portion of a different material.

"patterned layer" refers to a layer in which the material of the layer extends across only selected portions of a different material.

DETAILED DESCRIPTION

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. Figures may not be drawn to scale.

An abrasive article according to one exemplary embodiment is shown in FIG. 1 and herein designated by the numeral 100. The abrasive article 100, as shown, is comprised of a plurality of distinct layers. Listed in order from the back side (or bottom) of the abrasive article 100 to its working surface (or top), the layers include a first base layer 102, an ink layer 108, a second base layer 110, and an abrasive layer 112. Each of these will be described in further detail below.

As indicated in FIG. 1, the first base layer 102 has a first major surface 104 and a second major surface 106 opposite the first major surface 104. The first base layer 102 is preferably made from a polymeric film that imparts a high degree of flexibility and resiliency to the abrasive article 100.

In preferred embodiments, the first base layer 102 comprises an elastomeric film. The elastomeric film may be monolithic or may itself be a composite film having multiple layers produced by coextrusion, heat lamination, or adhesive bonding. Examples of materials that may be used in the elastomeric film include polyolefin, polyester (e.g., those available under the trade designation "HYTREL" from E.I. du Pont de Nemours & Co., Wilmington, Del.), polyamide, styrene/butadiene copolymer (e.g., those available under the trade designation "KRATON" from Kraton Polymers, Houston, Tex.), and polyurethane elastomers (e.g., those polyurethane elastomers available under the trade designation "ESTANE 5701" and "ESTANE 5702"); chloroprene rubber, ethylene/propylene rubbers, polybutadiene rubber, polyisoprene rubber, natural or synthetic rubber, butyl rubber, silicone rubber, or EPDM rubber; and combinations thereof. Further examples of useful elastomeric films include those described in U.S. Pat. No. 2,871,218 (Schollenberger); U.S. Pat. No. 3,645,835 (Hodgson); U.S. Pat. No. 4,595,001 (Potter et al.); U.S. Pat. No. 5,088,483 (Heinecke); U.S. Pat. No. 6,838,589 (Liedtke et al.); and RE33353 (Heinecke). Still other useful elastomeric films include pressure sensitive adhesive coated polyurethane elastomer films, commercially available from 3M Company, St. Paul, Minn., under the trade designation "TEGADERM."

Alternatively, the first base layer 102 may be made from a polymer derived from: 0-50 wt % carboxylic acid resins (for example, acrylate acid); 0-50 wt % of alkyl acrylates, alkyl methacrylates, and alkyl ethacrylates (for example, ethyl acrylate); 0-50 wt % unsaturated acetate (for example, vinyl acetate); and α-olefins (for example, ethylene) making up the balance. These resins may be completely or partially neutralized by metal hydroxides or other suitable basic materials.

In exemplary embodiments, the first base layer 102 has a percent elongation at break of at least 100 percent, at least 200 percent, at least 300 percent, at least 400 percent, or at least 500 percent, as measured under ambient conditions. Optionally, the first base layer 102 has a percent elongation at break of at most 1000 percent, at most 800 percent, at most 700 percent, at most 600 percent, or at most 500 percent, as measured under ambient conditions.

In this application, elongation at break is determined according to ASTM International Test Method D882-12, "Standard Test Method for Tensile Properties of Thin Plastic Sheeting," published in September 2012 by ASTM International, West Conshohocken, Pa., using an extension rate of ten percent of the gauge length per minute.

Preferred materials for the first base layer 102 are non-tacky under ambient conditions. For the purposes of this disclosure, the term "non-tacky" refers to a material that satisfies the Dahlquist criterion for a non-tacky substance, implying it has a storage modulus (G') of less than about $3\times10^5$ pascals (measured at 10 radians/second at ambient temperature), described in U.S. Pat. No. 6,884,504 (Liu et al.). Also cited in: Dahlquist Criterion, "Handbook of Pressure Sensitive Adhesive Technology," 2' ed. (1989), pp. 172-176. Substances having a storage modulus less than or equal to this threshold would be considered to display tack as defined by the Dahlquist criterion.

Preferred materials for the first (or second base layer) can have an elastic modulus of between 5 and 20,000 MPa, or alternatively between 10 and 10,000 MPa, or alternatively from 20 to 5,000 MPa, or alternatively from 30 to 1,000 MPa, or alternatively from 30 to 500 MPa. One way to measure the elastic modulus is to expose a cross-section of the layer, and perform indentation testing. This indentation testing can follow the principles of ASTM E2546 Standard Practice for Instrumented Indentation Testing, with the exception that contact stiffness can be determined via the Continuous Stiffness Method as found on the Agilent G200 which has greater accuracy for determination of contact stiffness than using the slope of the unloading curve, especially for soft materials in which creep artifacts the unloading curve.

A fused silica calibration standard (having a nominal E of 72 GPa) can be tested before and after sample testing to verify tip integrity. All testing can be conducted on an Aglient G200 nanoindenter with DCM head and Berkovich diamond probe at a constant strain rate of 0.05 $s^{-1}$ with an assumed Poisson ratio of 0.3. Sample cross-sections can be exposed via microtoming, mounting in one inch diameter epoxy pucks and subsequently polishing to a final finish with 0.1 μm diamond lapping film. The following test parameters may be used: 1) surface approach distance 5000 nm; 2) surface approach velocity 30 nm/s; 3) harmonic amplitude 1 nm; 4) harmonic oscillation 75 Hz; 5) depth set point 200 nm; 6) surface find contact stiffness 200 N/m. In some cases, the testing may need to continue past the 200 nm set point, if a steady-state has not been reached.

Preferred materials for the first or second base layers 102, 110 can have a hardness of between 1 and 2,000 MPa, or alternatively between 2 and 1,000 MPa, or alternatively from 4 to 500 MPa, or alternatively from 5 to 100 MPa, or alternatively from 5 to 30 MPa. This testing can be performed used the indentation method described above.

The first base layer 102 preferably has a thickness that is generally uniform across its major surfaces. The average thickness of the first base layer 102 may be at least 10 micrometers, at least 12 micrometers, at least 15 micrometers, at least 20 micrometers, or at least 25 micrometers. On the upper end, the average thickness may be at most 300 micrometers, at most 150 micrometers, at most 100 micrometers, at most 75 micrometers, or at most 50 micrometers. To enhance adhesion between the first base layer 102 and its neighboring layers, the first base layer 102 may be chemically primed or otherwise surface treated, for example by corona treatment, ultraviolet radiation treatment, electron beam treatment, flame treatment, or surface roughening.

Referring again to FIG. 1, the ink layer 108 is disposed on the first major surface 104 of the first base layer 102. Optionally and as shown, the ink layer 108 extends across the first major surface 104 and is in direct contact with the first major surface 104.

The composition of the ink layer 108 is not particularly restricted, and may include any of a number of solvents, pigments, dyes, resins, lubricants, solubilizers, surfactants, particulate matter, fluorescers, and other materials known to one skilled in the art, along with combinations thereof. Commonly, the ink layer 108 is suffused with color by either a dye or a pigment. Dye-based inks use a soluble colorant that is fully dissolved in a liquid medium. Pigmented ink, by contrast, typically uses a fine powder of solid colorant particles that is insoluble in a liquid carrier. Using known techniques, the ink can be transferred onto the first major surface 104 and then dried or cured to obtain the ink layer 108.

One useful technique for printing the ink layer 108 is flexographic printing, a process of direct rotary printing that uses resilient relief image plates of rubber or photopolymer material. The plates can be releasably attached to plate cylinders of various repeat lengths, inked by a cell-structured ink-metering roll, with or without a reverse-angle doctor blade. The roll conveys a fast drying fluid ink to the plates that print onto the substrate. Advantageously, flexography can be adapted to print graphics on a wide variety of substrates. Further details concerning flexographic printing are described in *Flexography: Principles and Practices,* $4^{th}$ ed., by the Foundation of Flexographic Technical Association, pp. 4-6 & 15-23.

The ink layer 108 of the abrasive article 100 may be continuous or discontinuous. As used herein, a continuous ink layer is unitary and extends across substantially the entire portion of the first major surface 104. By contrast, a discontinuous ink layer extends over two or more discrete, select areas along the first major surface 104. For example, a discontinuous layer would generally be used to print letters and words onto the abrasive article 100.

The ink layer 108 may also be either single-layered or multi-layered. The individual layers can be continuous or discontinuous. The layers can cover the same or different areas along the first major surface 104. Moreover, one layer can cover none of, partially cover, or fully cover another ink layer. Patterned layers may be in forms including, for example, lines, dots, squares, circles, and combinations thereof. Component layers of the ink layer 108 can be of uniform or varying thickness.

Where the ink layer 108 is present, the ink layer 108 preferably has an average overall thickness of at least 0.01 micrometers, at least 0.1 micrometers, at least 0.2 micrometers, at least 0.5 micrometers, or at least 1 micrometer. On the upper end, the ink layer 108 preferably has an average overall thickness of at most 10 micrometers, at most 5 micrometers, at most 2 micrometers, at most 1 micrometer, or at most 0.5 micrometers.

In alternative embodiments, the first base layer 102 and the ink layer 108 are separated by one or more interposed primer layers or tie layers. Depending on the particular ink formulation used, a primer layer or tie layer may assist to varying degrees in improving the adhesion between the ink layer 108 and the first base layer 102.

As further shown in FIG. 1, the second base layer 110 extends along the ink layer 108 opposite the first base layer 102 in symmetrical fashion, where the ink layer 108 is confined between the first and second base layers 102, 110. In some embodiments, the second base layer 110 is substantially the same as the first base layer 102. Preferably, either or both of the first and second base layers 102, 110 are thermoplastic polymer films. More preferably, either or both of the first and second base layers 102, 110 are thermoplastic polyurethane films with elastomeric properties.

While the second base layer 110 can share any of the aforementioned compositions, configurations, and properties that may characterize the first base layer 102, it is to be understood that the second base layer 110 may also be significantly different from the first base layer 102. For example, the second base layer 110 may be made from a stiffer polymer or have a significantly different thickness than the first base layer 102.

Together, the first base layer 102, the ink layer 108, and the second base layer 110 constitute the backing of the abrasive article 100 as illustrated.

Finally, the uppermost layer of the abrasive article 100 in FIG. 1 is the abrasive layer 112. Optionally and as shown, the abrasive layer 112 is a coated abrasive film. The coated abrasive film generally includes a plurality of abrasive particles 114 secured to a plurality of hardened resin layers. In some embodiments, the abrasive particles 114 are adhesively coupled to the second base layer 110 by implementing a sequence of coating operations involving a hardenable make layer 116 and size layer 118, and a supersize layer 120, as described for example in U.S. Patent Publication No. 2012/0000135 (Eilers et al.). When thus secured, the abrasive particles 114 are partially or fully embedded in respective layers 116, 118, 120, yet located at or sufficiently close to the surface of the abrasive article 100 whereby the abrasive particles 114 come into frictional contact with the substrate when the abrasive article 100 is rubbed against the substrate.

While not shown here, the abrasive layer 112 may instead comprise an abrasive composite where abrasive particles are uniformly mixed with a binder to form a viscous slurry. This slurry can then be cast and appropriately hardened (for example, using a thermal or radiation curing process) onto the second base layer 110 to obtain the abrasive layer 112.

As a further option, the abrasive slurry could be molded onto the second base layer 110, to form a structured abrasive. Structured abrasive coatings are generally made by mixing abrasive particles and a hardenable precursor resin in a suitable binder resin (or binder precursor) to form a slurry, casting the slurry between the underlying film and a mold having tiny geometric cavities, and then hardening the binder. After hardening, the resulting abrasive coating is formed into a plurality of tiny, precisely shaped abrasive composite structures affixed to the underlying film. The hardening of the binder can be achieved by exposure to an energy source. Such energy sources can include, for example, thermal energy and radiant energy derived from an electron beam, ultraviolet light, or visible light.

The abrasive particles 114 are not necessarily limited and may be composed of any of a wide variety of hard minerals known in the art. Examples of suitable abrasive particles include, for example, fused aluminum oxide, heat treated aluminum oxide, white fused aluminum oxide, black silicon carbide, green silicon carbide, titanium diboride, boron carbide, silicon nitride, tungsten carbide, titanium carbide, diamond, cubic boron nitride, hexagonal boron nitride, garnet, fused alumina zirconia, alumina-based sol gel derived abrasive particles, silica, iron oxide, chromia, ceria, zirconia, titania, tin oxide, gamma alumina, and combinations thereof. The alumina abrasive particles may contain a metal oxide modifier. The diamond and cubic boron nitride abrasive particles may be monocrystalline or polycrystalline.

In nearly all cases, there is a range or distribution of abrasive particle sizes. The number average particle size of the abrasive particles may range from between 0.001 and 300 micrometers, between 0.01 and 250 micrometers, or between 0.02 and 100 micrometers. Here, the particle size of the abrasive particle is measured by the longest dimension of the abrasive particle.

Optionally, the abrasive article 100 can be flexed in a continuous process following the abrasive coating operation. Typically this is accomplished by guiding the web around cylindrical bars of suitably small diameter to remove curvature. This has the benefit of reducing the extent of curl induced by the fabrication process and can also improve the overall flexibility of the abrasive article 100.

Figure 2:
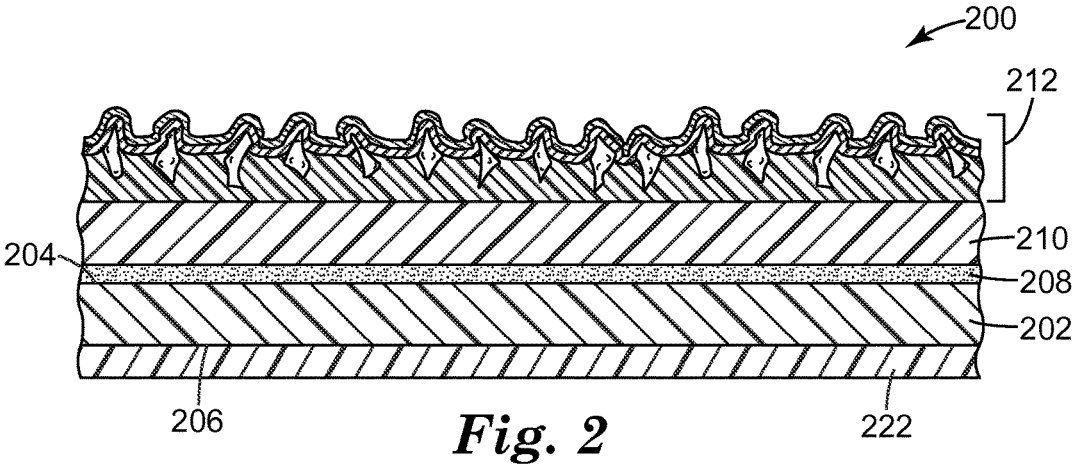
FIG. 2 is a side cross-sectional view of an abrasive article according to a second exemplary embodiment.

FIG. 2 shows an abrasive article 200 according to another exemplary embodiment. Like abrasive article 100, the abrasive article 200 shares many common features, including a first base layer 202 (having first and second major surfaces 204, 206), an ink layer 208, a second base layer 210, and an abrasive layer 212. As illustrated in FIG. 2, however, the abrasive article 200 further includes a support layer 222 extending across and contacting the second major surface 206 of the first base layer 202. In the finished abrasive article 200, the support layer 222 acts as a disposable liner that is manually stripped off before use.

In some embodiments, the support layer 222 is made from a polymer that is both heat-resistant and has a substantially higher stiffness than either of the first base layer 202 or second base layer 210. Various materials can be used for the support layer 222, including polypropylene, polyethylene, polyesters, silicone rubbers, and various copolymers of these materials. In some embodiments, the support layer 222 is made from a fluorinated polymer such as polytetrafluoroethylene. Some of the foregoing materials, such as polyethylene, polypropylene, and polyester, have relatively low heat distortion temperatures and may be limited to low temperature manufacturing processes. Other materials may require that a release agent be incorporated into, or coated onto, the support layer 222 to obtain facile release from the first base layer 202.

In a preferred embodiment, the support layer 222 is made from a polyester. A particularly suitable polyester material is polyethylene terephthalate.

The average thickness of the support layer 222 can be, in some embodiments, at least 10 micrometers, at least 12 micrometers, at least 15 micrometers, at least 20 micrometers, or at least 25 micrometers. In some embodiments, the average thickness of the support layer 222 can be at most 200 micrometers, at most 150 micrometers, at most 100 micrometers, at most 75 micrometers, or at most 50 micrometers.

Besides serving a protective function in the packaging of the abrasive article 200, the support layer 222 can also serve an important function during the manufacturing of the abrasive article 200, as shall be described in the forthcoming paragraphs.

Figure 3:
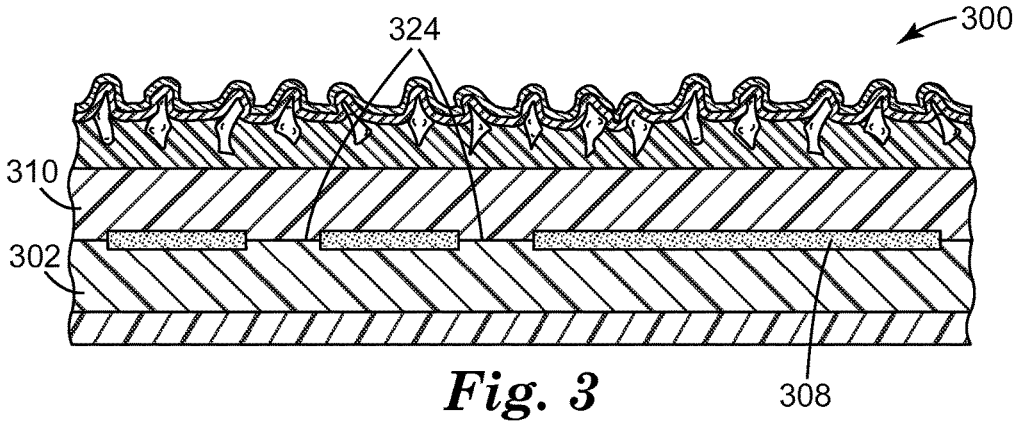
FIG. 3 is a side cross-sectional view of an abrasive article according to a third exemplary embodiment.

FIG. 3 shows an abrasive article 300 according to still another embodiment. The abrasive article 300 has a multilayered structure largely resembling those of abrasive articles 100, 200 but differs in the configuration of its ink layer 308. While the ink layers 108, 208 of abrasive articles 100, 200 are shown extending over substantially all of the first base layer 102, 202, the abrasive article 300 shows a discontinuous ink layer 308 that produces uncoated regions 324 between first and second base layers 302, 310. As shown in FIG. 3, the first base layer 302 and the second base layer 310 directly contact each other along the uncoated regions 324.

The uncoated regions 324 can provide a significant benefit in enhancing the integrity of the abrasive article 300 over the course of repeated use. In practice, the bond strength between the first base layer 302 and the second base layer 310 was observed to be quite high when using thermoplastic elastomers, particularly when similar thermoplastic elastomers are used for the two layers, and even more when the two layers are the same thermoplastic elastomer. This tends to be significantly higher than, for example, either the interfacial bond strength between the ink layer 308 and the base layers 302, 310 or the cohesive strength of the ink layer 308 itself. As a result, the uncoated regions 324 act as weld points along the interface between first and second base layers 302, 310 that greatly increases the overall cohesive strength of the adhesive. This benefit is noteworthy since the ink layer, in general, cannot tolerate deformation as effectively as the adjacent base layers. This exacerbates the problem of delamination between layers when the multilayered abrasive article is stretched along transverse directions. The use of a discontinuous ink layer 308 here can effectively mitigate this problem.

Figure 4:
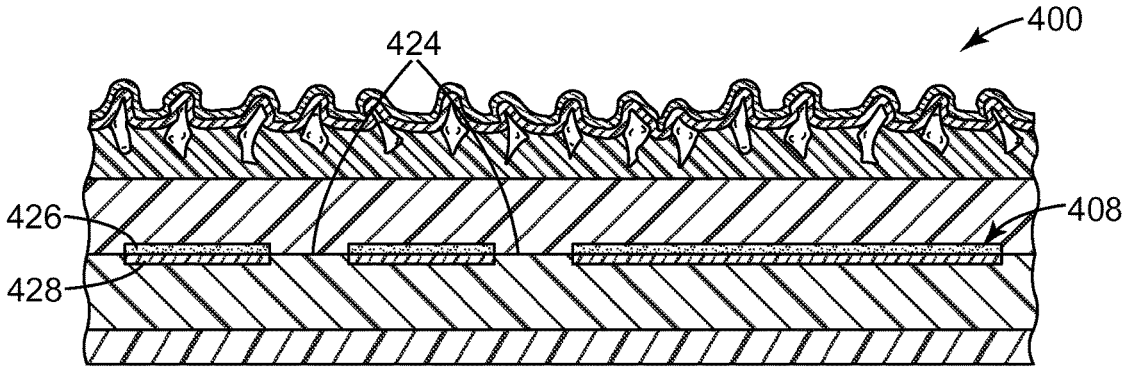
FIG. 4 is a side cross-sectional view of an abrasive article according to a fourth exemplary embodiment.

FIG. 4 shows another abrasive article 400, which is analogous to the abrasive article 300 in FIG. 3 in most respects but uses a composite ink layer 408. The composite ink layer 408 is comprised of first ink layer 428 and a second ink layer 426 that are coextensive with each other. Advantageously, the composite ink layer 408 is overall discontinuous in nature, providing for uncoated regions 424 that act to strengthen the abrasive article 400 for the reasons previously explained. Although not explicitly shown here, it is understood that a third, fourth, or fifth ink layer, etc. can be applied in layered fashion to obtain printed images having the desired shapes and colors. It is further understood that the constituent ink layers (such as first and second ink layers 428, 426 shown) need not be mutually coextensive. In FIG. 4, for example, the first ink layer 428 could extend over an area smaller than that covered by the second ink layer 426.

While certain embodiments of the inventive abrasive articles are described with reference to FIGS. 1-4, these are not exhaustive. For example, although not shown in the drawings, the abrasive article may optionally include an attachment interface layer that is adhesively, chemically, or mechanically attached to the first base layer 102 of the abrasive article 100 in FIG. 1. Such attachment interface layer could also be disposed, for example, between the first base layer 202 and the support layer 222 of the abrasive article 200 shown in FIG. 2.

Advantageously, an attachment interface layer facilitates the coupling of the abrasive article to a support structure such as, for example, a backup pad which can in turn be secured to a power tool. The attachment interface layer may be, for example an adhesive (e.g., a pressure-sensitive adhesive) layer, a double-sided adhesive tape, a loop fabric for a hook and loop attachment (e.g., for use with a backup or support pad having a hooked structure affixed thereto), a hooked structure for a hook and loop attachment (e.g., for use with a back up or support pad having a looped fabric affixed thereto), or an intermeshing attachment interface layer (e.g., mushroom type interlocking fasteners designed to mesh with a like mushroom type interlocking fastener on a back up or support pad). Options and advantages associated with such attachment interface layers are described, for example, in U.S. Pat. No. 5,152,917 (Pieper et al.); U.S. Pat. No. 5,254,194 (Ott); U.S. Pat. No. 5,201,101 (Rouser et al.); and U.S. Pat. No. 6,846,232 (Braunschweig et al.); and U.S. Patent Publication 2003/0022604 (Annen et al.).

The foregoing abrasive articles can be fabricated using a sequence of batch or continuous web coating processes. The abrasive article 100, for example, could be prepared by initially extrusion coating the first base layer 102 onto a suitable support layer (having, for example, the characteristics of support layer 222) and printing the ink layer 108 onto the exposed major surface 104 of the first base layer 102 opposite the support layer. After the ink layer 108 has been cured or otherwise hardened, the second base layer 110 can then be extrusion coated, optionally using a process similar to that above, onto the ink layer 108 to confine the ink layer 108 between the first and second base layers 102, 110. Finally, the abrasive layer 112 can be applied onto the second base layer 110 using any of the known abrasive coating techniques described previously and the support layer stripped off to provide the finished abrasive article 100.

Other manufacturing pathways are possible. For example, two or more composite films can be made separately and then laminated or otherwise coupled together.

In one alternative method, the first base layer 102 is extrusion coated onto a first support layer and the ink layer 108 is then printed onto an exposed major surface of the first base layer to provide a first composite film. The second base layer 110 is then extrusion coated onto a second support layer, the abrasive layer 112 coated onto the second base layer 110, and the second support layer subsequently removed from the second base layer 110 to provide a second composite film. Finally, the first and second composite films can then be laminated to each other by thermally bonding the now exposed surface of the second base layer 110 to the exposed surface of the ink layer 108 and the first support layer stripped off to provide the finished abrasive article 100.

In a variation of the above method, the first base layer 102 can be extrusion coated onto a first support layer and the ink layer 108 is then printed onto an exposed major surface of the first base layer to provide a first composite film. The second base layer 110 is then extrusion coated onto a second support layer. The second base layer is laminated to the first base layer 102 by thermally bonding the exposed surface of the second base layer 110 to the ink layer 108. The second base layer can then be stripped off, and abrasive layer 112 applied to the now exposed surface. The first support layer may optionally be stripped off to provide the finished abrasive article 100.

Further permutations of the above steps may also be advantageously used, provided that the step of printing the ink layer takes place on a supported base layer film that lacks an abrasive coating.

The provided articles and methods can be further exemplified by the embodiments 1-30 set out below:

1. A flexible abrasive article including: a first base layer having opposed first and second major surfaces, where the first base layer is non-tacky under ambient conditions; an ink layer disposed on the first major surface of the first base layer; a second base layer disposed on the ink layer whereby the ink layer is located between the first and second base layers and where the second base layer includes a thermoplastic; and an abrasive layer disposed on the second base layer whereby the second base layer is located between the abrasive layer and the ink layer.

2. The flexible abrasive article of embodiment 1, where the first base layer includes a thermoplastic.

3. The flexible abrasive article of embodiment 2, where either the first base layer or second base layer includes a thermoplastic polyurethane.

4. The flexible abrasive article of embodiment 3, where both the first and second base layers include a thermoplastic polyurethane.

5. The flexible abrasive article of any one of embodiments 2-4, where both the first and second base layers include a thermoplastic elastomer.

6. The flexible abrasive article of any one of embodiments 1-5, where both the first and second base layer have an elongation to break ranging from 200 percent to 600 percent.

7. The flexible abrasive article of embodiment 6, where both the first and second base layer have an elongation to break ranging from 300 percent to 500 percent.

8. The flexible abrasive article of embodiment 7, where both the first and second base layer have an elongation to break ranging from 350 to 410.

9. The flexible abrasive article of any one of embodiments 1-8, where the first base layer has a thickness ranging from 5 micrometers to 500 micrometers.

10. The flexible abrasive article of embodiment 9, where the first base layer has a thickness ranging from 10 micrometers to 250 micrometers.

11. The flexible abrasive article of embodiment 10, where the first base layer has a thickness ranging from 20 micrometers to 150 micrometers.

12. The flexible abrasive article of any one of embodiments 1-11, where the ink layer is discontinuous such that the first and second base layers contact each other along areas coplanar with, and peripheral to, the ink layer.

13. The flexible abrasive article of embodiment 12, where the ink layer includes two or more layers of flexographic ink.

14. The flexible abrasive article of embodiment 13, where the two or more layers of flexographic ink extend over different areas along the first major surface.

15. The flexible abrasive article of any one of embodiments 1-14, where the second base layer has a thickness ranging from 5 micrometers to 500 micrometers.

16. The flexible abrasive article of embodiment 15, where the second base layer has a thickness ranging from 10 micrometers to 250 micrometers.

17. The flexible abrasive article of embodiment 16, where the second base layer has a thickness ranging from 20 micrometers to 150 micrometers.

18. The flexible abrasive article of any one of embodiments 1-17, where the abrasive layer includes a coated abrasive.

19. The flexible abrasive article of embodiment 18, where the coated abrasive includes: a make layer disposed on the second base layer; a plurality of abrasive particles secured to the make layer; a size layer disposed on both the make layer and abrasive particles; and optionally a supersize layer disposed on the size layer.

20. The flexible abrasive article of any one of embodiments 1-19, further including a support layer disposed on the second major surface of the first base layer, whereby the first base layer is located between the support layer and the ink layer.

21. The flexible abrasive article of embodiment 20, where the support layer includes a polyester.

22. The flexible abrasive article of embodiment 21, where the polyester includes polyethylene terephthalate.

23. The flexible abrasive article of any one of embodiments 20-22, where the support layer has a thickness ranging from 10 micrometers to 300 micrometers.

24. The flexible abrasive article of embodiment 23, where the support layer has a thickness ranging from 20 micrometers to 200 micrometers.

25. The flexible abrasive article of embodiment 24, where the support layer has a thickness ranging from 10 micrometers to 75 micrometers.

26. A method of making an abrasive article including: extrusion coating a first base layer onto a support layer, the first base layer presenting an exposed major surface that is non-tacky at ambient conditions; printing an ink layer onto the exposed major surface opposite the support layer; extrusion coating a second base layer onto the ink layer to confine the ink layer between the first and second base layers, where the second base layer includes a thermoplastic; and applying an abrasive coating onto the second base layer.

27. The method of embodiment 26, further including removing the support layer from the first base layer subsequent to applying the abrasive coating.

28. A method of making an abrasive article including: extrusion coating a first base layer onto a first support layer, where the first base layer is non-tacky at ambient conditions; providing a first composite film by printing an ink layer onto an exposed major surface of the first base layer; extrusion coating a second base layer; providing a second composite film by applying an abrasive coating onto the second base layer; and coupling the first and second composite films to each other by thermally bonding the second base layer to the ink layer.

29. The method of embodiment 28, where extrusion coating the second base layer includes extrusion coating the second base layer onto a second support layer and providing the second composite film further includes removing the second support layer from the second base layer.

30. The method of embodiment 28 or 29, where the second base layer includes a thermoplastic.

EXAMPLES

Objects and advantages of this disclosure are further illustrated by the following non-limiting examples. Particular materials and amounts thereof recited in these examples, however, as well as other conditions and details, should not be construed to unduly limit this disclosure.

The following abbreviations are used to describe the examples:

° C.: degrees Centigrade
cm: centimeter
g/eq.: grams per equivalent
$g/m^2$: grams per square meter
g/mol: grams per mole
mil: $10^{-3}$ inch
mm: millimeter
μm: micrometer
UV: ultraviolet
W/in: Watts per inch
W/cm: Watts per centimeter Unless stated otherwise, all reagents were obtained or are available from chemical vendors such as Sigma-Aldrich Company, St. Louis, Mo., or may be synthesized by known methods. Unless otherwise reported, all ratios are by weight.

Abbreviations for materials and reagents used in the examples are as follows:

ACR: Trimethylolpropane triacrylate.
AMOX: Di-t-amyl oxalate.
CHDM: 1,4-cyclohexanedimethanol.
EP1: A bisphenol-A epichlorohydrin based epoxy resin having an epoxy equivalent weight of 525-550 g/eq. and an average epoxy functionality of 2, available as "EPON 1001F" from Momentive Specialty Chemicals, Inc., Columbus, Ohio.
EP2: A bisphenol-A epoxy resin having an epoxy equivalent weight of 185-192 g/eq. and an average epoxy functionality of 2, available as "EPON 828" from Momentive Specialty Chemicals, Inc., Columbus, Ohio.
EP3: (3',4'-epoxycyclohexylmethyl) 3',4'-epoxycyclohexanecarboxylate.
ESTANE: A thermoplastic polyether-based polyurethane resin, obtained under the trade designation "ESTANE 58887 NAT 021" from Lubrizol Advanced Materials, Cleveland, Ohio.
FLL: An inorganic micronized functional filler, obtained under the trade designation "MINEX 3" from Unimin Corp, New Canaan, Conn.
P100: A grade P100 aluminum oxide abrasive mineral, obtained under the trade designation "ALODUR BFRPL" from Treibacher Industrie AG.
P400: A grade P400 aluminum oxide abrasive mineral, obtained under the trade designation "ARTIRUNDUM SFB" from ART Abrasives Co. Ltd.
P600: A grade P600 aluminum oxide abrasive mineral, obtained under the trade designation "ALODUR BFRPL" from Treibacher Industrie AG.
P800: A grade P800 aluminum oxide abrasive mineral, obtained under the trade designation "ALODUR BFRPL" from Treibacher Industrie AG.
P1000: A grade P1000 aluminum oxide abrasive mineral, obtained under the trade designation "ALODUR BFRPL" from Treibacher Industrie AG.
P1200: A grade WA800 aluminum oxide abrasive mineral, obtained under the trade designation WA Abrasives Grade 800 from Fujimi Corporation.
P1500: A grade WA1000 aluminum oxide abrasive mineral, obtained under the trade designation WA Abrasives Grade 1000 from Fujimi Corporation.
PC1: Mixture of 4-thiophenylphenyl diphenyl sulfonium hexafluoroantimonate, and bis[4-(diphenylsulfonio)phenyl]sulfide bis(hexafluoroantimonate) in propylene carbonate, obtained under the trade designation CPI 6976 from Aceto Corporation, Port Washington, N.Y.
PC2: 2,2-dimethoxy-2-phenylacetophenone, obtained under trade designation IRGACURE 651 from BASF, Wyandotte, Mich.
PC3: $\eta^6$-[xylene(mixed-isomers)]$\eta^5$-cyclopentadienyliron (1+) hexafluoro antimonate(1−).
PC4: Ethyl (2,4,6-trimethylbenzoyl) phenylphosphinate, obtained under the trade designation IRGACURE TPO-L from BASF, Wyandotte, Mich.
PEP: A high molecular weight, hydroxyl-terminated, saturated, linear, semi-crystalline, copolyester, with a weight average molecular weight of 35,000 g/mol, available as "DYNAPOL S 1227" from Evonik Industries, Parsippany, N.J.
PET: A 1.97 mil (50 μm) thick polyester terephthalate film, obtained under the trade designation 602197 PET FILM from 3M Company.
PI: 2-hydroxy-2-methyl-1-phenyl-1-propanone.
Prop Carb: Propylene carbonate, obtained under the trade designation JEFFSOL PC from Huntsman Corp, Woodlands, Tex.
UBI: A black ink, obtained under the trade designation HK11900174/K538, FLEXOMAX from Sun Chemical Corporation, Parsippany, N.J.

UGI: A gold ink, obtained under the trade designation ULTRABOND 871C Real Gold, WKJFSM171134/K53 from Sun Chemical Corporation, Parsippany, N.J.

URI: A red ink, obtained under the trade designation Flexomax 032 Red HF11400652 from Sun Chemical Corporation, Parsippany, N.J.

ZNST: A 39-41 percent by weight aqueous zinc stearate soap dispersion obtained under trade designation EC994C from eChem LTD, Leeds, UK.

Preparation of Make Resin

A series of make resins were prepared as follows, according to the compositions listed in Table 1. AMOX, EP1, EP2, CHDM and PEP were directly metered to a twin screw extruder running at 300 rpm with temperature zones of 30, 105, 110, 100, 65, and 60° C. This mixed resin was then fed to a pin mixer running at 1750 rpm, and ACR, PC2, PC3, PC4, and PropCarb were directly metered into the pin mixer. The output from the pin mixer was fed to a heated coating die, where the flow rate from the pin mixer was controlled so as to achieve the make resin target on the abrasive backing as listed in Table 5.

TABLE 1

| | MAKE RESIN COMPOSITION (% By Wt.) | | | | | | |
|---|---|---|---|---|---|---|---|
| COMPONENT | 1 | 2 | 3 | 4 | 5 | 6 | 7 |
| EP1 | 26.6 | 24.0 | 24.0 | 24.0 | 22.0 | 22.0 | 22.0 |
| EP2 | 34.5 | 32.0 | 32.0 | 32.0 | 32.0 | 30.0 | 30.0 |
| PEP | 28.4 | 28.0 | 28.0 | 28.0 | 28.0 | 28.0 | 28.0 |
| ACR | 4.5 | 10.0 | 10.0 | 10.0 | 12.0 | 14.0 | 14.0 |
| CHDM | 2.8 | 2.8 | 2.8 | 2.8 | 2.8 | 2.8 | 2.8 |
| PC2 | 0.5 | 0.5 | 0.5 | 0.5 | 0.5 | 0.5 | 0.5 |
| PC3 | 0.7 | 0.7 | 0.7 | 0.7 | 0.7 | 0.7 | 0.7 |
| PC4 | 0.3 | 0.3 | 0.3 | 0.3 | 0.3 | 0.3 | 0.3 |
| PropCarb | 1.1 | 1.1 | 1.1 | 1.1 | 1.1 | 1.1 | 1.1 |
| AMOX | 0.6 | 0.6 | 0.6 | 0.6 | 0.6 | 0.6 | 0.6 |

Preparation of Size Resin

Table 2 below lists the components and the amounts used to formulate the Size Resins 1 and 2. Each size resin was prepared by combining and mixing EP2, EP3 and ACR, and optionally FLL, in a container. Prior to abrasive making, PC1 and PI were added to the premixed resin batch and stirred for 30 minutes at room temperature until homogeneous.

TABLE 2

| INGREDIENT TYPE | Size Resin 1 (% By Wt.) | Size Resin 2 (% By Wt.) |
|---|---|---|
| EP2 | 38 | 0 |
| EP3 | 29 | 44 |
| ACR | 29 | 19 |
| FLL | 0 | 33 |
| PC1 | 3 | 3 |
| PI | 1 | 1 |

Abrasion Test Method

After removal of the PET liner, the sample was wrapped around a No. 20 sponge pad sold under the trade designation WETORDRY (Part No. 05526), obtained from 3M Company. Different sized pieces of this pad were used for different examples, as shown in Table 3 below. A 6 inch×9 inch section of an automotive test panel, obtained from ACT Test Laboratories, LLC, Hillsdale, Mich., was manually sanded with the abrasive film covered sponge pad for 30 seconds. The weight loss (cut) and surface finish, Rz, of the test panel were measured, the latter using a model "SURTRONIC 25" surface profilometer, obtained from Taylor Hobson, Ltd., Leicester, England. The cut data shown in Table 4 reflect an average of three sanding tests. Surface finish data reflect an average of three measurements from each of three test panels.

TABLE 3

| Sample | Size of Sanding Pad |
|---|---|
| Example 1 | 133 mm × 66.7 mm |
| Example 2 | 133 mm × 66.7 mm |
| Example 3 | 133 mm × 66.7 mm |
| Example 4 | 133 mm × 66.7 mm |
| Example 5 | 133 mm × 66.7 mm |
| Example 6 | 133 mm × 66.7 mm |
| Example 7 | 133 mm × 66.7 mm |
| Example 8 | 66.7 mm × 57.1 mm |
| Example 9 | 66.7 mm × 57.1 mm |
| Example 10 | 66.7 mm × 57.1 mm |
| Example 11 | 133 mm × 35 mm |
| Example 12 | 66.7 mm × 57.1 mm |
| Comparative A | 133 mm × 66.7 mm |

Example 1

ESTANE resin was extrusion cast as a first thermoplastic polyurethane film, at an average thickness of 2 mils (50.8 μm), onto the 1.97 mil (50.04 μm) PET by means of single-screw extruder. Gold ink UGI was applied to the entire surface of the ESTANE film by means of a flexographic printer and drying was accomplished with heated forced air convection. A black text image comprising the mineral grade, 3M brand identification and a three character lot code were then printed over the gold ink using black ink UBI. The grade designation and 3M brand logo designation were printed in Arial font, 7/16 inch (11.1 mm) tall, the lot code was printed in Arial font, ¼ inch (6.35 mm) tall. After the text image dried, a second 3 mil (76.2 μm) film of ESTANE was extrusion cast over the ink layer. Make Resin 1 was coated onto the second ESTANE film at a nominal coating weight of 22 g/m$^2$ and the film assembly passed under a Fusion UV Systems with one set of D-bulbs and one set of V-bulbs, both operating at 600 W/in (236 W/cm). Abrasive mineral P100 was then coated onto the make layer at a nominal coating weight of 175 g/m$^2$ and the web was then heated under infrared heaters, at a nominal web temperature setting of 100° C., for about 7 seconds. The Size Resin 2 was then roll coated onto the make layer and abrasive particles at a nominal dry coating weight of 135 g/m$^2$ and passed under a Fusion UV Systems with one set of H-bulbs, and two sets of D-bulbs, all three operating at 600 W/in (236 W/cm). It was then processed through infrared ovens having a target exit web temperature of 125° C. ZNST at a nominal coating weight of 16 g/m$^2$ was then coated onto the size layer and processed through a drying oven with a target exit web temperature of 135° C. The resultant coated abrasive articles were then maintained at room temperature (i.e., 20-24° C.) and 40-60 percent relative humidity until tested.

The abrasive web was then flexed by wrapping it around a first ¼ inch (6.35 mm) diameter round metal bar with the backside of the abrasive in contact with the metal bar. The bar was oriented at a 45° angle relative to the web direction. The web was wrapped around the ¼ inch (6.35 mm) diameter bar such that approximately one half of the bar was in contact with the backside of the web. This resulted in a configuration in which the web movement prior to the bar was opposite the direction of web movement after the bar. Once the web moved past this first bar, the abrasive web was wrapped around a second ¼ inch (6.35 mm) diameter round metal bar with the backside of the abrasive in contact with the metal bar. This second bar was also at a 45° angle relative to the web direction, and a 90° orientation from the first bar. The wrap angle for the first and second bars was the same, and in both cases the backside of the abrasive was in contact with the bar.

The PET liner was removed and the abrasive tested according to the ABRASION TEST METHOD, yielding the results shown in Table 4. The abrasive thus produced was further stretched by 60%, and then folded such that the abrasive surfaces were facing outward and the ESTANE surfaces were in contact with each other. The resulting crease was rubbed with finger pressure and it was noted that only a minimal amount of the abrasive coating separated from the substrate.

TABLE 4

| Sample | Cut (grams/30 seconds) | Rz (μ-inch/μm) |
|---|---|---|
| Example 1 | 0.267 | 516/13.11 |
| Example 2 | 0.210 | 148/3.76 |
| Example 3 | 0.163 | 82/2.08 |
| Example 4 | 0.117 | 57/1.45 |
| Example 5 | 0.093 | 77/1.96 |
| Example 6 | 0.110 | 42/1.07 |
| Example 7 | 0.077 | 45/1.14 |
| Example 8 | 0.183 | 123/3.14 |
| Example 9 | 0.183 | 126/3.20 |
| Example 10 | 0.163 | 124/3.15 |
| Example 11 | 0.113 | 70/1.78 |
| Example 12 | 0.097 | 46/1.17 |
| Comparative A | 0.113 | 71/1.80 |

Example 2

The procedure generally described in Example 1 was repeated, wherein the Make Resin 1 was replaced by the Make Resin 2 in Table 1 and the Size Resin 2 was replaced by the Size Resin 1 in Table 2. The coating weights of Make, Mineral, Size and ZNST were changed to match those given in Table 5, with the Mineral Grade specified in the table.

TABLE 5

| | Ex. 1 | Ex. 2 | Ex. 3 | Ex. 4 | Ex. 5 | Ex. 6 | Ex. 7 |
|---|---|---|---|---|---|---|---|
| Mineral Grade | P100 | P400 | P600 | P800 | P1000 | WA 800 | WA 1000 |
| Make Weight | 22 | 16.5 | 16.5 | 16.5 | 16.5 | 16.5 | 16.5 |
| Mineral Weight | 175 | 40 | 28 | 25 | 23 | 20 | 17 |
| Size Weight | 135 | 26 | 13 | 11 | 10 | 10 | 7 |
| ZNST Weight | 16 | 12 | 9 | 8.5 | 8 | 6.5 | 6.5 |

Example 3

The procedure generally described in Example 1 was repeated, wherein the Make Resin 1 was replaced by the Make Resin 3 in Table 1 and the Size Resin 2 was replaced by the Size Resin 1 in Table 2. The coating weights of Make, Mineral, Size and ZNST were changed to match those given in Table 5, with the Mineral Grade specified in the table.

Example 4

The procedure generally described in Example 1 was repeated, wherein the Make Resin 1 was replaced by the Make Resin 4 in Table 1 and the Size Resin 2 was replaced by the Size Resin 1 in Table 2. The coating weights of Make, Mineral, Size and ZNST were changed to match those given in Table 5, with the Mineral Grade specified in the table.

Example 5

The procedure generally described in Example 1 was repeated, wherein the Make Resin 1 was replaced by the Make Resin 5 in Table 1 and the Size Resin 2 was replaced by the Size Resin 1 in Table 2. The coating weights of Make, Mineral, Size and ZNST were changed to match those given in Table 5, with the Mineral Grade specified in the table.

Example 6

The procedure generally described in Example 1 was repeated, wherein the Make Resin 1 was replaced by the Make Resin 6 in Table 1 and the Size Resin 2 was replaced by the Size Resin 1 in Table 2. The coating weights of Make, Mineral, Size and ZNST were changed to match those given in Table 5, with the Mineral Grade specified in the table.

Example 7

The procedure generally described in Example 1 was repeated, wherein the Make Resin 1 was replaced by the Make Resin 7 in Table 1 and the Size Resin 2 was replaced by the Size Resin 1 in Table 2. The coating weights of Make, Mineral, Size and ZNST were changed to match those given in Table 5, with the Mineral Grade specified in the table.

Example 8

ESTANE resin was extrusion cast as a first thermoplastic polyurethane film, at an average thickness of 2.0 mil (50.8 μm), onto the 1.97 mil (50.04 μm) PET by means of the single-screw extruder. Black ink text over the gold ink background were then printed on the exposed ESTANE surface according to the procedure described in Example 1.

ESTANE resin was extrusion cast as a second thermoplastic polyurethane film, at an average thickness of 5.3 mil (134.6 μm), onto the 1.97 mil (50.04 μm) PET by means of the single-screw extruder. An abrasive coating was then applied to the ESTANE surface of this second film according to the procedure generally described in Example 2.

The PET liner was removed from this second film sample to expose the opposing, non-abrasive surface of the thermoplastic polyurethane film. This non-abrasive surface was laminated onto the printed surface of the first thermoplastic polyurethane film by means of a hydraulic platen press at 121° C. for approximately one minute with an applied pressure of about 360 psi (2.48 MPa). This construction was removed from the press and allowed to cool to 21° C.

This laminated film was then flexed and stretched according to the procedure described in Example 1. Only a very minimal amount of the abrasive coating separated from the substrate.

Another piece of the abrasive thus produced was tested according to the ABRASION TEST METHOD, and the results are shown in Table 4.

Example 9

The procedure generally described in Example 8 was repeated, wherein the second thermoplastic polyurethane film was reduced from 5.3 mil (134.6 microns) to 2.0 mil (50.8 μm).

Example 10

The procedure generally described in Example 8, wherein the second thermoplastic polyurethane film was reduced from 5.3 mil (134.6 μm) to 1.0 mil (25.4 μm).

Example 11

ESTANE resin was extrusion cast as a first thermoplastic polyurethane film, at an average thickness of 2.3 mils (58.4 μm), onto the 1.97 mil (50.04 μm) PET by means of single-screw extruder to produce a first film sample. The ESTANE surface of this film was then printed using a flexographic printing process. Red ink URI was applied to the surface of the ESTANE film by means of a flexographic printer and forced air convection was applied to dry the ink. The red ink UGI was applied using a Seamex 2 flexographic printing plate (available from OEC, Oshkosh, Wis.) that contained a regular array of dots at line screen of 133 lines per inch (52.4 lines per cm). The dot size was such that the dots comprised 40% of the plate area. A black text image, containing the P800 grade designation, 3M brand identification and a three character lot code was then printed over the red ink using black ink UBI. The P800 grade designation was printed in Arial font, and it was 7/16 inch (11.1 mm) tall. The 3M brand designation was printed in 3M logo font, and it was also 7/16 inch (11.1 mm) tall. The lot code was printed in Arial font, ¼ inch (6.35 mm) tall.

ESTANE resin was extrusion cast as a second thermoplastic polyurethane film, at an average thickness of 5.3 mils (134.6 μm), onto the 1.97 mil (50.04 μm) PET by means of single-screw extruder to produce a second film sample. An abrasive coating was then applied to the ESTANE surface of this second film according to the procedure generally described in Example 4.

The PET liner was removed from this second film to expose a TPU surface. This TPU surface was then contacted with the printed surface of the first film sample, and a combination of heat and pressure were applied using a hydraulic platen press. The dwell time in the press was about one minute at temperature of about 121° C. with an applied pressure of about 360 pounds per square inch (2.48 MPa). This construction was removed from the press and allowed to cool to 21° C.

This laminated film was then flexed and stretched according to the procedure described in Example 1. The remaining PET liner was removed. This abrasive was stretched by 60%, and then folded such that the abrasive surfaces were facing outward and the ESTANE surfaces were in contact with each other. The resulting crease was rubbed with finger pressure and it was noted that only a minimal amount of the abrasive coating separated from the substrate.

Another piece of the abrasive thus produced was tested according to the ABRASION TEST METHOD, and the results are shown in Table 4.

Example 12

ESTANE resin was extrusion cast as a first thermoplastic polyurethane film, at an average thickness of 5.3 mils (134.6 μm), onto the 1.97 mil (50.04 μm) PET by means of a single screw extruder.

Black ink text over the gold ink background were then printed on the exposed ESTANE surface according to the procedure generally described in Example 1.

ESTANE resin was extrusion cast as a thermoplastic polyurethane film at an average thickness of 5.3 mils (134.6 μm), onto the 1.97 mil (50.04 μm) PET by means of a single screw extruder to produce a second film sample. The ESTANE surface of this second film was contacted with the printed surface of the first film, and a combination of heat and pressure were applied using a hydraulic platen press. The dwell time in the press was about one minute at temperature of about 121° C. with an applied pressure of about 86 pounds per square inch (0.6 MPa). This construction was removed from the press and allowed to cool to 21° C.

The PET liner that was part of the second film was removed from the construction. An abrasive coating was applied to this exposed ESTANE surface using the materials and methods described in Example 7.

The sample was then flexed and stretched according to the procedure described in Example 1. The remaining PET liner was removed. This abrasive was stretched by 60%, and then folded such that the abrasive surfaces were facing outward and the ESTANE surfaces were in contact with each other. The resulting crease was rubbed with finger pressure and it was noted that only a minimal amount of the abrasive coating separated from the substrate.

Another piece of the abrasive thus produced was tested according to the ABRASION TEST METHOD, and the results are shown in Table 4.

Comparative A

ESTANE resin was extrusion cast as a first thermoplastic polyurethane film, at an average thickness of 5.3 mils (134.6 μm), onto the 1.97 mil (50.04 μm) PET by means of a single screw extruder. Gold ink UGI was applied to the entire surface of the ESTANE film by means of a flexographic printer, and forced air convection was applied to dry the ink. Black ink text over the gold ink background were then printed on the exposed ESTANE surface according to the procedure generally described in Example 1.

An abrasive coating was applied to this printed surface using the materials and methods described in Example 5.

This laminated film was then flexed and stretched according to the procedure described in Example 1. The remaining PET liner was removed. This abrasive was stretched by 60%, and then folded such that the abrasive surfaces were facing outward and the ESTANE surfaces were in contact with each other. The resulting crease was rubbed with finger pressure and it was noted that a significant amount of the abrasive coating separated from the substrate.

Another piece of the abrasive thus produced was tested according to the ABRASION TEST METHOD and the results are shown in Table 4.

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A flexible abrasive article comprising:

a first base layer having opposed first and second major surfaces, wherein the first base layer is non-tacky under ambient conditions;

an ink layer disposed on the first major surface of the first base layer;

a second base layer disposed on the ink layer whereby the ink layer is located between the first and second base layers and wherein the second base layer comprises a thermoplastic; and an abrasive layer disposed on the second base layer whereby the second base layer is located between the abrasive layer and the ink layer.

2. The flexible abrasive article of claim 1, wherein the first base layer comprises a thermoplastic.

3. The flexible abrasive article of claim 2, wherein either the first base layer or second base layer comprises a thermoplastic polyurethane.

4. The flexible abrasive article of claim 3, wherein both the first and second base layers comprise a thermoplastic polyurethane.

5. The flexible abrasive article of claim 2, wherein both the first and second base layers comprise a thermoplastic elastomer.

6. The flexible abrasive article of claim 1, wherein the ink layer is discontinuous such that the first and second base layers contact each other along areas coplanar with, and peripheral to, the ink layer.

7. The flexible abrasive article of claim 1, wherein the abrasive layer comprises a coated abrasive.

8. The flexible abrasive article of claim 7, wherein the coated abrasive comprises:

a make layer disposed on the second base layer;

a plurality of abrasive particles secured to the make layer; and a size layer disposed on both the make layer and abrasive particles.

9. The flexible abrasive article of claim 1, further comprising a support layer disposed on the second major surface of the first base layer, whereby the first base layer is located between the support layer and the ink layer.

10. The flexible abrasive article of claim 9, wherein the support layer comprises a polyester.

11. A method of making an abrasive article comprising:

extrusion coating a first base layer onto a support layer, the first base layer presenting an exposed major surface that is non-tacky at ambient conditions;

printing an ink layer onto the exposed major surface opposite the support layer;

extrusion coating a second base layer onto the ink layer to confine the ink layer between the first and second base layers, wherein the second base layer comprises a thermoplastic; and applying an abrasive coating onto the second base layer.

12. The method of claim 11, further comprising removing the support layer from the first base layer subsequent to applying the abrasive coating.

13. A method of making an abrasive article comprising:

extrusion coating a first base layer onto a first support layer, wherein the first base layer is non-tacky at ambient conditions;

printing an ink layer onto an exposed major surface of the first base layer;

extrusion coating a second base layer;

applying an abrasive coating onto the second base layer; and thermally bonding the second base layer to the ink layer.

14. The method of claim 13, wherein extrusion coating the second base layer comprises extrusion coating the second base layer onto a second support layer and further comprising removing the second support layer from the second base layer.

15. The method of claim 13, wherein the second base layer comprises a thermoplastic.

* * * * *